US005834675A

United States Patent [19]

Boss

[11] Patent Number: 5,834,675

[45] Date of Patent: Nov. 10, 1998

[54] METHOD FOR DETERMINING THE DISAGGREGATION TIME OF A PROGRAMMABLE PROJECTILE

[75] Inventor: André Boss, Zürich, Switzerland

[73] Assignee: Oerlikon Contraves AG, Zürich, Switzerland

[21] Appl. No.: 749,329

[22] Filed: Nov. 14, 1996

[30] Foreign Application Priority Data

Apr. 19, 1996 [CH] Switzerland ..... 1001/96

[51] Int. Cl.[6] ..... F42C 13/00

[52] U.S. Cl. ..... 89/6.5; 235/408

[58] Field of Search ..... 235/417, 408; 89/6.5, 6; 73/167; 102/489, 211

[56] References Cited

U.S. PATENT DOCUMENTS

| | | | |
|---|---|---|---|
| 4,142,442 | 3/1979 | Tuten . | |
| 4,267,776 | 5/1981 | Eickerman | 102/215 |
| 4,449,041 | 5/1984 | Girard . | |
| 4,625,646 | 12/1986 | Pinson | 102/489 |
| 4,750,423 | 6/1988 | Nagabhushan | 89/1.51 |
| 4,799,429 | 1/1989 | LaBudde et al. | 102/293 |
| 4,837,718 | 6/1989 | Alon | 364/565 |
| 4,955,279 | 9/1990 | Nahrwold | 89/6.5 |
| 4,957,046 | 9/1990 | Puttock | 102/489 |
| 4,960,055 | 10/1990 | Dieval | 102/489 |
| 5,413,029 | 5/1995 | Gent et al. | 89/41.3 |
| 5,497,704 | 3/1996 | Kurschner et al. | 102/264 |

FOREIGN PATENT DOCUMENTS

| | | | |
|---|---|---|---|
| 0300255 | 1/1989 | European Pat. Off. . | |
| 0467055 | 1/1992 | European Pat. Off. . | |
| 3309147 | 9/1984 | Germany | 89/6.5 |
| 2107835 | 5/1983 | United Kingdom . | |

OTHER PUBLICATIONS

"Ahead—Skyguard Fire Control/35 mm Twin Gun Air Defence System Demonstration"; Oerlikon–Contraves, Sep. 1993.

*Primary Examiner*—Charles T. Jordan
*Assistant Examiner*—Christopher K. Montgomery
*Attorney, Agent, or Firm*—Browdy and Neimark

[57] ABSTRACT

It is possible to improve the hit probability of programmable projectiles by means of this method. For this purpose a predetermined optimal disaggregation distance (Dz) between a disaggregation point (Pz) of the projectile (18) and an impact point (Pf) on the target is maintained constant by the correction of the disaggregation time (Tz) of the projectile (18). The correction is performed by adding a correcting factor, which is multiplied by a velocity difference, to the disaggregation time (Tz). The velocity difference is formed from the difference between the actually measured projectile velocity and a lead velocity of the projectile, wherein the lead velocity is calculated from the average value of a number of previous successive projectile velocities.

3 Claims, 3 Drawing Sheets

Figure 1:
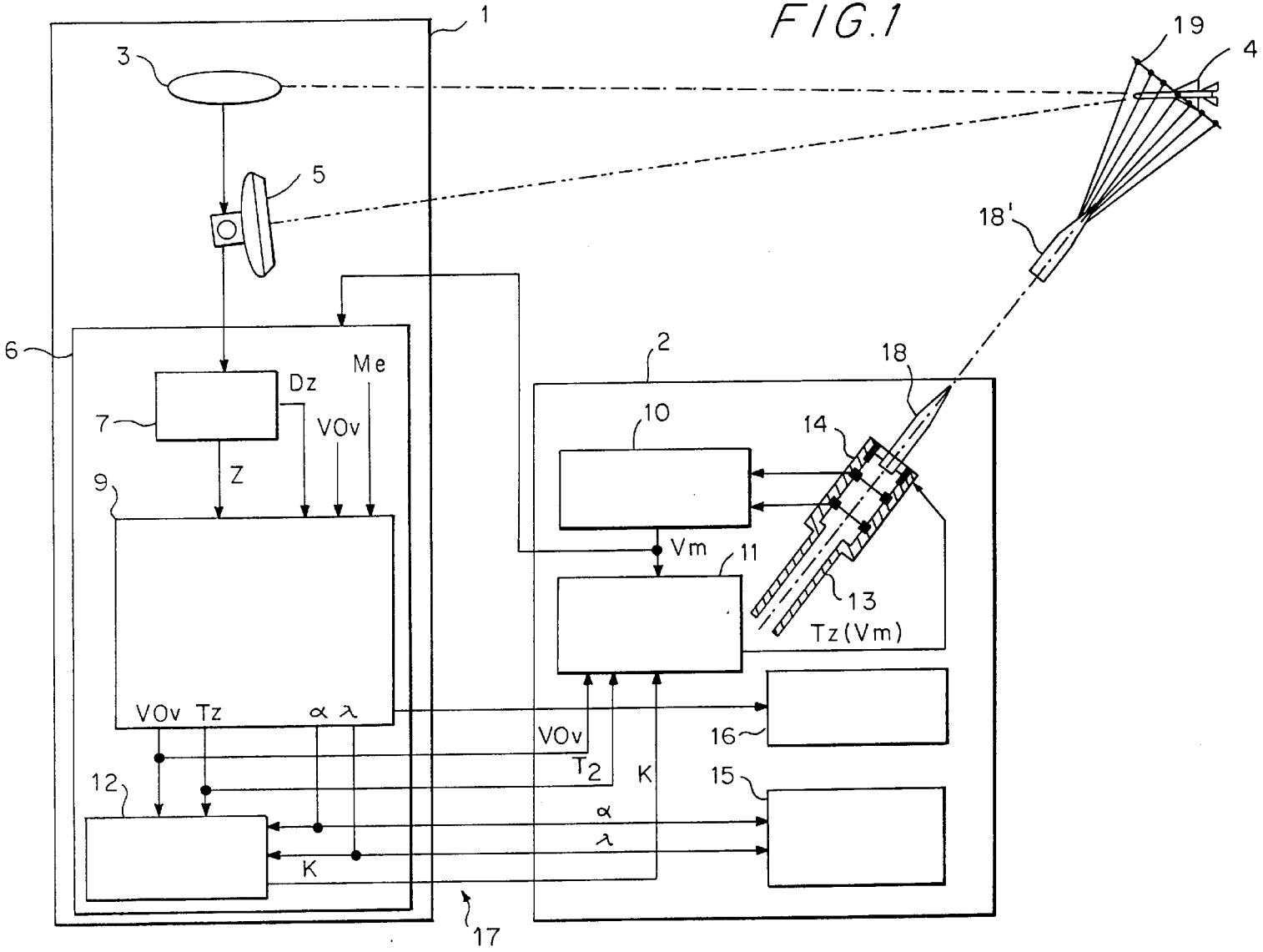

1
2
3
4
5
6
7
9
10
11
12
13
14
15
16
17
18
18'
19
Me
VOv
Dz
Z
Tz
VOv
α λ
K
Vm
Tz(Vm)
T2
α
λ

METHOD FOR DETERMINING THE DISAGGREGATION TIME OF A PROGRAMMABLE PROJECTILE

The invention relates to a process for determining the disaggregation time of a programmable projectile, wherein the calculation is at least based on an impact distance to a target determined from sensor data, a projectile velocity measured at the muzzle of a gun barrel and a predetermined optimal disaggregation distance between an impact point and a disaggregation point of the projectile.

A device has become known from European patent application 0 300 255 which has a measuring device for the projectile velocity disposed at the muzzle of a gun barrel. The measuring device consists of two toroid coils arranged at a defined distance from each other. Because of the change of the magnetic flux created during the passage of a projectile through the two toroid coils, a pulse is generated in each toroid coil in rapid succession. The pulses are provided to an electronic evaluation device, in which the velocity of the projectile is calculated from the chronological distance between the pulses and the distance between the toroid coils. A transmitter coil for the velocity is disposed behind the measuring device in the direction of movement of the projectile, which acts together with a receiver coil provided in the projectile. The receiver coil is connected via a high pass filter with a counter, whose output side is connected with a time fuse. A disaggregation time is formed from the calculated velocity of the projectile and an impact distance to a target, which is inductively transmitted to the projectile directly after the passage through the measuring device. The time fuse is set by means of this disaggregation time, so that the projectile can be disaggregated in the area of the target.

If projectiles with sub-projectiles are employed (projectiles with primary and secondary ballistics) it is possible, for example as known from pamphlet OC 2052 d 94 of the Oerlikon-Contraves company of Zürich, to destroy an attacking target by multiple hits if, following the ejection of the sub-projectiles at the time of disaggregation, the expected area of the target is covered by a cloud constituted by the sub-projectiles. In the course of disaggregation of such a projectile the portion carrying the sub-projectiles is separated and ripped open at predetermined breaking points. The ejected sub-projectiles describe a spin-stabilized flight path caused by the rotation of the projectile and are located evenly distributed on approximately semicircular curves of circles of a cone, so that a good probability of an impact can be achieved.

It is not always possible with the above described device to achieve a good hit or shoot-down probability in every case because of dispersions in the disaggregation distance caused, for example, by fluctuations of the projectile velocity and/or use of non-actualized values. Although the circle would become larger with larger disaggregation distances, the density of the sub-projectiles would become less. The opposite case occurs with shorter disaggregation distances: the density of the sub-projectiles would be greater, but the circle smaller.

It is the object of the invention to propose a process in accordance with the preamble, by means of which an optimum hit or shoot-down probability can be achieved, while avoiding the above mentioned disadvantages.

This object is attained by the invention disclosed in claim 1. Here, a defined optimal disaggregation distance between a disaggregation point of the projectile and an impact point on the target is maintained constant by correcting the disaggregation time. The correction is performed in that a correction factor multiplied by a velocity difference is added to the disaggregation time. The difference in the projectile velocity is formed from the difference between the actually measured projectile velocity and a lead velocity of the projectile, wherein the lead velocity of the projectile is calculated from the average value of a number of previous successive projectile velocities.

The advantages which can be achieved by means of the invention reside in that a defined disaggregation distance is independent of the actually measured projectile velocity, so that it is possible to achieve a continuous optimal hit or shoot-down probability. The correction factor proposed for the correction of the disaggregation time is merely based on the relative speed of the projectile-target and a derivation of the ballistics at the impact point.

Figure 2:
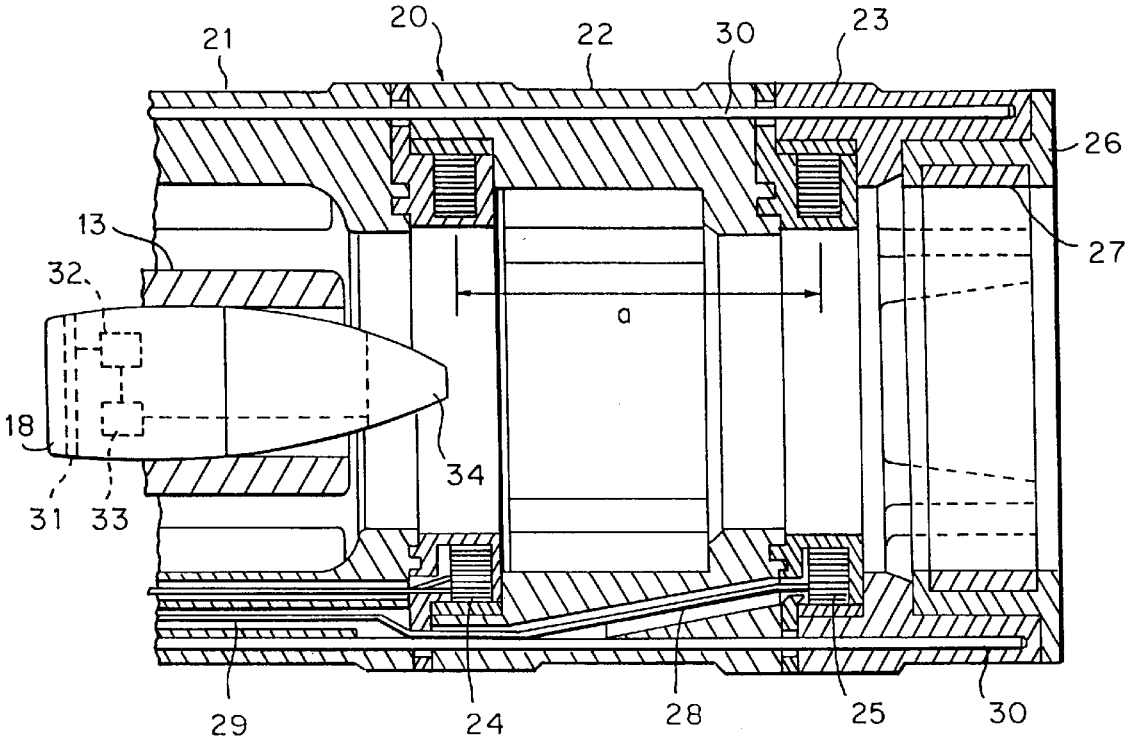
Figure 3:
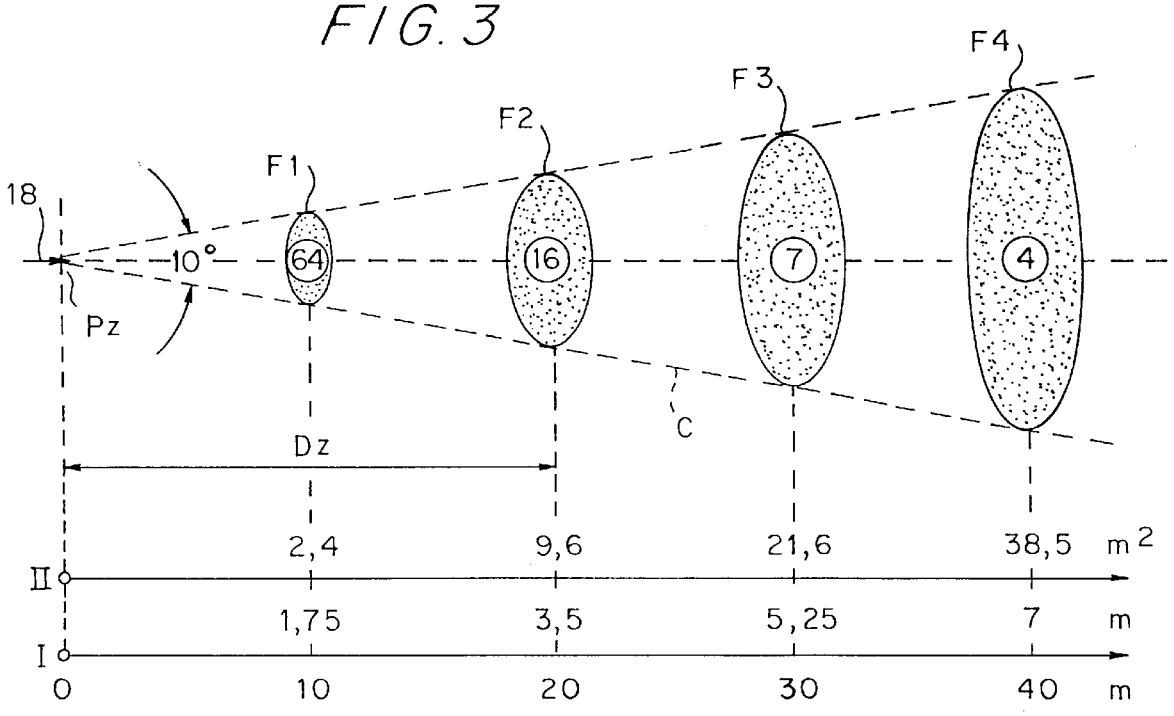
Figure 4:
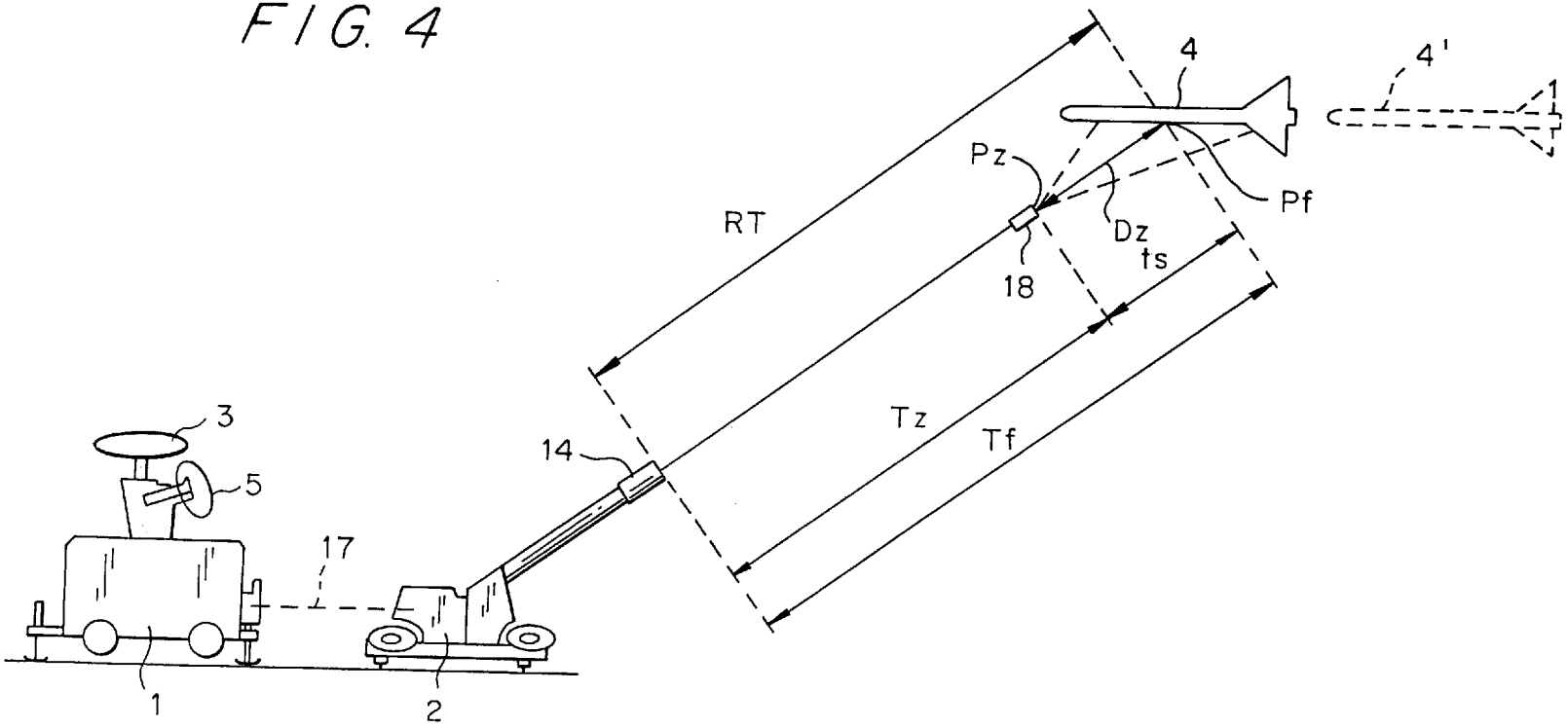

The invention will be explained in greater detail below by means of an exemplary embodiment in connection with the drawings. Shown are in:

FIG. 1 a schematic representation of a weapons control system with the device in accordance with the invention, FIG. 2 a longitudinal section through a measuring and programming device, FIG. 3 a diagram of the distribution of sub-projectiles as a function of the disaggregation distance, and FIG. 4 a different representation of the weapons control system in FIG. 1.

In FIG. 1, a firing control is indicated by 1 and a gun by 2. The firing control 1 consists of a search sensor 3 for detecting a target 4, a tracking sensor 5 for target detection connected with the search radar 3 for 3-D target following and 3-D target surveying, as well as a fire control computer 6. The fire control computer 6 has at least one main filter 7, a lead computing unit 9 and a correction computing unit 12. On the input side, the main filter 7 is connected with the tracking sensor 5 and on the output side with the lead computing unit 9, wherein the main filter 7 passes on the 3-D target data received from the tracking radar 5 in the form of estimated target data 2, such as position, velocity, acceleration, etc., to the lead computing unit 9, whose output side is connected with the correction computing unit. Meteorological data can be supplied to the lead computing unit 9 via a further input Me. The meaning of the identifiers at the individual junctions or connections will be explained in more detail below by means of the description of the functions.

A computer of the gun 2 has an evaluation circuit 10 and an update computing unit 11. On the input side, the evaluation circuit 10 is connected with a measuring device 14 for the projectile velocity disposed on the muzzle of a gun barrel 13, which will be described in greater detail below by means of FIG. 2, and on the output side with the lead computing unit 9 and the update computing unit 11. On the input side, the update computing unit 11 is connected with the lead and with the correction computing units 9, 12, and is connected on the output side with a programming element integrated into the measuring device 14. The correction computing unit 12 is connected on the input side with the lead computing unit 9, and on the output side with the update computing unit 11. A gun servo device 15 and a triggering device 16 reacting to the fire command are also connected with the lead computing unit 9. The connections between the fire control 1 and the gun 2 are combined into a data transmission device which is identified by 17. The meaning of the identifiers at the individual connections between the computing units 10, 11, 12 as well as between the fire control 1 and the gun 2 will be explained in greater detail below by means of the description of the functions. A projectile is identified by 18 and 18' and is represented in a programming phase (18) and at the time of disaggregation (18'). The projectile 18 is a programmable projectile with primary and secondary ballistics, which is equipped with an ejection load and a time fuse and filled with sub-projectiles 19.

In accordance with FIG. 2, a support tube 20 fastened on the muzzle of the gun barrel 13 consists of three parts 21, 22, 23. Toroid coils 24, 25 for measuring the projectile velocity are arranged between the first part 21 and second and third parts 22, 23. A transmitter coil 27, contained in a coil body 26, is fastened on the third part 23—also called a programming part. The manner of fastening of the support tube 20 and the three parts 21, 22, 23 with each other will not be further represented and described. Soft iron rods 30 are arranged on the circumference of the support tube 20 for the purpose of shielding against magnetic fields interfering with the measurements. The projectile 18 has a receiver coil 31, which is connected via a filter 32 and a counter 33 with a time fuse 34. During the passage of the projectile 18 through the toroid coils 24, 25, a pulse is generated in rapid succession in each toroid coil. The pulses are supplied to the evaluation circuit 10 (FIG. 1), in which the projectile velocity is calculated from the chronological distance between the pulses and a distance a between the toroid coils 24, 25. Taking the projectile velocity into consideration, a disaggregation time is calculated, as will be described in greater detail below, which is inductively transmitted in digital form during the passage of the projectile 18 by means of the transmitter coil 27 to the receiver coil 31 for the purpose of setting the counter 32.

A disaggregation point of the projectile 18 is indicated by Pz in FIG. 3. The ejected sub-projectiles are located, depending on the distance from the disaggregation point Pz, evenly distributed on approximately semicircular curves of (perspectively drawn) circular surfaces F1, F2, F3, F4 of a cone C. The distance from the disaggregation point Pz in meters m is plotted on a first abscissa I, while the sizes of the surfaces F1, F2, F3, F4 are plotted in square meters $m^2$ and their diameters in meters m on a second abscissa II. With a characteristic projectile with, for example, 152 sub-projectiles, and a vertex angle of the cone C of initially 10°, the values plotted on the abscissa II result as a function of the distance. The density of the sub-projectiles located on the circular surfaces F1, F2, F3, F4 decreases with increasing distance and under the selected conditions is 64, 16, 7 and 4 sub-projectiles per square meter. With a predetermined disaggregation distance Dz of, for example 20 m, on which the calculation which follows has been based, a target area of the example used of 3.5 m diameter would be covered by 16 sub-projectiles per square meter.

The target to be defended against is identified by 4 and 4' in FIG. 4 and is represented in an impact and a launch position (4) and in a position (4') which precedes the impact or the launch position.

The above described device operates as follows:

With projectiles with primary and secondary ballistics, the lead computing unit 9 calculates an impact distance RT and a sub-projectile flying time ts from a predetermined disaggregation distance Dz, a lead velocity VOv and the target data Z, taking into consideration meteorological data. Here, Tz is the flight time of the projectile to the disaggregation point Pz and ts is the flying time from the disaggregation point Pz to the impact point Pf of a sub-projectile flying in the direction of the projectile (FIGS. 3, 4).

For example, the lead velocity VOv is formed from the average values of a number of projectile velocities Vm supplied via the data transmission device 17, which have immediately preceded the actually measured projectile velocity Vm.

The lead computing unit 9 furthermore detects a gun angle α of the azimuth and a gun angle λ of the elevation. The values α, λ, Tz and VOv are supplied to the correction computing unit 12, which calculates a correction factor K as described in more detail below. The values α, λ, VOv and K are designated as shooting elements of the impact point and are supplied to the gun computer via the data transmission device 17, wherein the shooting elements α and λ are supplied to the gun servo device 15 and the shooting elements VOv, Tz and K to the update computing unit 11. If only the primary ballistics are employed, the impact time Tf=Tz+ts is supplied instead of the disaggregation time Tz. (FIG. 1, FIG. 4).

The above described calculations are performed repeatedly in a clocked manner, so that the new data α, λ, Tz or Tf, VOv and K are available for a preset valid time in the respective actual clock period i.

Interpolation or extrapolation is respectively performed for the actual (current) time (t) between the clocked values.

The ballistics of a projectile are described by means of a system of differential equations of the form $$\dot{\bar{p}}_G=\bar{v}_G \qquad \text{Eq. 1}$$

$$\dot{\bar{v}}_G=f(\bar{p}_G, \bar{v}_G) \qquad \text{Eq. 2}$$

wherein, together with the initial conditions $$\bar{p}_G(0)=P\bar{o}s(t_o,\bar{v}_o(t_o)),\ \bar{v}_G(0)=\bar{v}_o(t_o)$$

an unequivocal ballistic solution $$t\mapsto\bar{p}_G(t,\ P\bar{o}s(t_o,\bar{v}_o(t_o)),\ \bar{v}_o(t_o)),$$

$$t\mapsto\bar{v}_G(t,\ P\bar{o}s(t_o,\bar{v}_o(t_o)),\ \bar{v}_o(t_o))$$

is determined. In the system defined by equations Eq. 1 and Eq. 2, the impact condition $$\bar{p}_G(TG,\ P\bar{o}s(t_o,\ \bar{v}_o(t_o)),\ \bar{v}_o(t_o))=\bar{p}_z(t_o+TG) \qquad \text{Eq. 3}$$

is contained as a marginal condition, wherein $TG=TG(t_o, \bar{v}_o(t_o))$, and wherein the lead value $\bar{v}_o(t_o)$ of the projectile is not assumed to be the initial velocity. A component of $\bar{v}_o(t_o)$ in the barrel direction is defined by $$\bar{v}_o^{(1)} = \|\bar{v}_o^{(1)}\| \cdot \frac{P\bar{o}s(t_o,\ \bar{v}_o(t_o))}{\|P\bar{o}s(t_o,\ \bar{v}_o(t_o))\|}$$

and a component oriented perpendicularly in respect to it is defined by $\bar{v}_o^{(2)}$, so that $$\bar{v}_o(t_o)^x+\bar{v}_o^{(1)}+\bar{v}_o^{(2)} \qquad \text{Eq. 4}$$

wherein $$\bar{v}_o^{(2)}=P\bar{o}s(t_o,\ \bar{v}_o(t_o))$$

identifies the velocity of the barrel mouth and is a lead value which is actually maintained by the projectile. However, it is not possible a priori to provide a statement regarding the amount of the component of the initial velocity of the projectile in the direction of the barrel. Indeed, the value $$v_o=v_o(t_o):=\|\bar{v}_o^{(1)}\|$$

is not exactly assumed by the projectile. The actual value of the component of the initial velocity of the projectile in the direction of the barrel is identified by Vm. This value is measured for each projectile at the barrel mouth (FIGS. 1 and 2). The effective initial velocity of the projectile now is $$\bar{v}_G(0) = v_m \cdot \frac{\bar{v}_o^{(1)}}{v_o} + \bar{v}_o^{(2)} = v_m \cdot \frac{\overline{Pos}(t_o, \bar{v}_o(t_o))}{\|\overline{Pos}(t_o, \bar{v}_o(t_o))\|} + \overline{Pos}(t_o, \bar{v}_o(t_o)). \quad \text{Eq. 5}$$

For the sake of simplicity it is possible to replace the dependence on the initial velocity by the dependence on the value of the component of the initial velocity in the direction of the barrel, so that $$TG = TG(t_o, v_o),\ \overline{Pos} = \overline{Pos}(t_o, v_o) =: \overline{Pos}_o$$

and the ballistic solution $$t \mapsto \bar{p}_G(t, \overline{Pos}_o, v_o)$$

$$t \mapsto \bar{v}_G(t, \overline{Pos}_o, v_o)$$

results. With the effective initial velocity in accordance with equation Eq. 5, the solution of the equations Eq. 1, Eq. 2 takes the form $$t \mapsto \bar{p}_G(t, \overline{Pos}_o, v_m),$$

$$t \mapsto \bar{v}_G(t, \overline{Pos}_o, v_m).$$

A projectile with the path given by $t \mapsto \bar{p}_G(t, \overline{Pos}_o, v_m)$ generally will no longer hit the target. Therefore, when calculating the correction factor K, the basis is the flying time t* over the shortest distance between a projectile and a target provided by the definition $$t^* = t^*(v_m) := \inf_t \{\|\bar{p}_G(t, \overline{Pos}_o, v_m) - \bar{p}_Z(t_o + t)\|^2\}$$

and the partial derivation in accordance with the flying time $$\begin{aligned} &\frac{\partial}{\partial t} \|\bar{p}_G(t, \overline{Pos}_o, v_m) - \bar{p}_Z(t_o + t)\|^2_{t=t^*} \quad \text{Eq. 6} \\ &= 2\langle \bar{v}_G(t^*, \overline{Pos}_o, v_m) - \bar{v}_Z(t_o + t^*), \bar{p}_G(t^*, \overline{Pos}_o, v_m) - \bar{p}_Z(t_o + t^*)\rangle \\ &= 0 \end{aligned}$$

and equation Eq. 6 is simplified by inserting the definition $$\bar{p}_{rel}(v_m) := \bar{p}_G(t^*(v_m), \overline{Pos}_o, v_m) - \bar{p}_Z(t_o + t^*(v_m)),$$

$$\bar{v}_{rel}(v_m) := \bar{v}_G(t^*(v_m), \overline{Pos}_o, v_m) - \bar{v}_Z(t_o + t^*(v_m)) = \bar{p}_{rel}(v_m),$$

$$\bar{a}_{rel}(v_m) := \bar{a}_G(t^*(v_m), \overline{Pos}_o, v_m) - \bar{a}_Z(t_o + t^*(v_m)) = \bar{v}_{rel}(v_m),$$

By means of differentiating the equation Eq. 6

$$\begin{aligned} &(\bar{a}_{rel}(v_m) \cdot D_1 t^*(v_m) + D_3 \bar{v}_G(t^*(v_m), \overline{Pos}_o, v_m), \bar{p}rel(v_m) + (\bar{v}_{rel}(v_m), \\ &\bar{v}_{rel}(v_m) \cdot D_1 t^*(v_m) + D_3 \bar{p}_G(t^*(v_m), \overline{Pos}_o, v_m)) = 0 \quad \text{Eq. 7} \end{aligned}$$

is obtained. Subsequently, the hit condition in accordance with equation Eq. 3, contained as a marginal condition in the system of the differential equations of ballistics, is inserted, taking into consideration the definition of t*

$$t^*(v_o) = TG$$

$$\bar{p}rel(v_o) = \bar{p}_G(TG, \overline{Pos}_o, v_o) - \bar{p}_z(t_o + TG) = 0$$

from which follows $$D_1 t^*(v_o) = -\frac{\langle \dot{\bar{v}}_{rel}(v_o), D_3 \bar{p}_G(TG, \overline{Pos}_o, v_o)\rangle}{\langle \bar{v}_{rel}(v_o), \bar{v}_{rel}(v_o)\rangle} \quad \text{Eq. 7.1}$$

for Vm=Vo from equation Eq. 7. By inserting the definition $$\frac{\partial \bar{p}_G}{\partial v_o} := D_3 \bar{p}_G(TG, \overline{Pos}_o, v_o)$$

the equation Eq. 7 is simplified, the result of which is the correction factor K as $$K := D_1 t^*(v_o) = -\frac{\langle \bar{v}_{rel}(v_o), \frac{\partial \bar{p}_G}{\partial v_o}\rangle}{\langle \bar{v}_{rel}(v_o), \bar{v}_{rel}(v_o)\rangle} \quad \text{Eq. 8}$$

The mathematical or physical notation used above means:

| | |
|---|---|
| $\vec{\upsilon}$ | a vector |
| $\|\vec{\upsilon}\|$ | the standard of a vector |
| $\langle \vec{\mu}, \vec{\upsilon} \rangle$ | scalar product |
| $\vec{\mu} \times \vec{\upsilon}$ | vector product |
| Id | uniform matrix |
| • | scalar or matrix multiplication |
| g := A. | the value g is defined as the expression A |
| $g = g(x_1, \ldots, x_n)$ | the value g depends on $x_1, \ldots, x_n$ |
| $t \mapsto g(t)$ | assignment (the evaluation of g at point t is assigned to t) |
| $\dot{g}$ | derivative of g in accordance with time |
| $D_i\, g(x_1, \ldots, x_n)$ | partial derivative of g after the i-th variable |
| $\frac{\partial}{\partial t} g(t, x_1, \ldots, x_n)$ | partial derivative of g after the time t4 |
| $\inf_t M$ | lower limit of the amount M over all t |
| $\vec{p}_G, \vec{\upsilon}_G, \vec{\alpha}_G$ | position, velocity, acceleration of the projectile |
| $\vec{p}_Z, \vec{\upsilon}_Z, \vec{\alpha}_Z$ | position; velocity, acceleration of the target |
| $\vec{p}_{rel}, \vec{\upsilon}_{rel}, \vec{\alpha}_{rel}$ | relative position, velocity, acceleration projectile-target |
| $\vec{Pos}$ | position of the mouth of the barrel |
| $\vec{\upsilon}_o$ | initial lead velocity of the projectile |
| $\upsilon_o$ | amount of the component of the initial lead velocity of the projectile in the barrel direction |

-continued

| | |
|---|---|
| $\upsilon_m$ | amount of the component of the effective initial speed of the projectile in the barrel direction |
| TG | lead flying time of the projectile |
| $t^*$ | flying time of the projectile |
| $t_o$ | time at which the projectile passes the mouth of the barrel |

The update computing unit 11 calculates a corrected disaggregation time Tz(Vm) from the correction factor K supplied by the correction computing unit 12, the actually measured projectile speed Vm supplied by the evaluation circuit 10 and from the lead velocity Vov and disaggregation time Tz supplied by the lead computing unit 9, in accordance with the equation $$Tz(Vm)=Tz+K^*(Vm-VOv)$$

The corrected disaggregation time Tz(Vm) is interpolated or extrapolated for the actual current time t depending on the valid time. The disaggregation time Tz(Vm) now calculated is provided to the transmitter coil 27 of the programming unit 23 of the measuring device 14 and is inductively transmitted to a passing projectile 18 as already previously described in connection with FIG. 2.

It is possible to maintain the disaggregation distance Dz (FIGS. 3, 4) constant, independently of the fluctuations in the projectile velocity and/or caused by the employment of non-actualized values, by means of the correction of the disaggregation time Tz, so that it is possible to achieve an optimal hit or shoot-down probability.

LIST OF REFERENCE CHARACTERS

1
Fire control
2
Gun
3
Search sensor
4
Target
5
Tracking sensor
6
Fire control computer
7
Main filter
9
Lead computing unit
10
Evaluation circuit
11
Update computing unit
12
Correction computing unit
13
Gun barrel
14
Measuring device
15
Gun servo device
16
Triggering device
17
Data transmission device
18
Projectile
18'
Projectile
19
Sub-projectile
20
Support tube
21
First part
22
Second part
23
Third part
24
Toroid coil
25
Toroid coil
26
Coil body
27
Transmitter coil
28
Line
29
Line
30
Soft iron rods
31
Receiver coil
32
Filter
33
Counter
34
Time fuse
a
Distance
pz
Position of the disaggregation point
F1–F4
Circular surfaces
C
Cone
I
First abscissa
II
Second abscissa
Dz
Disaggregation distance
RT
Impact distance VOv
Lead velocity
Vm
Actual measured velocity
Tz
Disaggregation time
ts
Sub-projectile flying time
Pf
Impact point
α
Gun angle
λ
Gun angle
Tf
Impact time
TG
Flying time
Tz(Vm)
Corrected disaggregation time
Me
Input (meteorol.)
Z
Target data

I claim:

1. A process for determining the disaggregation time of a programmable projectile, wherein the calculation is at least based on an impact distance (RT) to a target determined from sensor data, a projectile velocity (Vm) measured at the muzzle of a gun barrel (13) and a predetermined disaggregation distance (Dz) between an impact point (Pf) and a disaggregation point (Pz) of the projectile (18), characterized in that the predetermined disaggregation distance (Dz) is maintained constant by a correction of the disaggregation time (Tz), wherein the correction is performed by means of the equation $$Tz(Vm)=Tz+K^*(Vm-Vov)$$

and wherein

TZ(Vm)
means the corrected disaggregation time,
Tz
the disaggregation time,
K
a correction factor,
Vm
the actually measured projectile velocity, and
Vov
a lead velocity of the projectile.

characterized in that the correction factor (K) is determined, starting from the flying time (t*) over the shortest distance between a projectile and a target provided by the definition $$t^*=t^*(v_m)=inf\{\|\bar{p}_G(t,\ P\bar{o}s_o,\ v_m)-\bar{p}_Z(t_o+t)\|^2\}$$

and the partial derivation in accordance with the flying time $$\begin{aligned}&\frac{\partial}{\partial t}\ \|\bar{p}_G(t, P\bar{o}s_o, v_m)-\bar{p}_Z(t_o+t)\|^2_{t=t^*} \qquad \text{Eq. 6}\\ =\ & 2<\bar{v}_G(t^*, P\bar{o}s_o, v_m)-\bar{v}_Z(t_o+t^*), \bar{p}_G(t^*, P\bar{o}s_o, v_m)-\bar{p}_Z(t_o+t^*)>\\ =\ & 0\end{aligned}$$

through the following calculating steps —simplification of the equation Eq. 6 by inserting the definitions $$\bar{p}_{rel}(v_m):=\bar{p}_G(t^*(v_m),\ P\bar{o}s_o,\ v_m)-\bar{p}_Z(t_o+t^*(v_m)),$$

$$\bar{v}_{rel}(v_m):=\bar{v}_G(t^*(v_m),\ P\bar{o}s_o,\ v_m)-\bar{v}_Z(t_o+t^*(v_m))=\bar{p}_{rel}(v_m),$$

$$\bar{a}_{rel}(v_m):=\bar{a}_G(t^*(v_m),\ P\bar{o}s_o,\ v_m)-\bar{a}_Z(t_o+t^*(v_m))=\bar{v}_{rel}(v_m),$$

—differentiation of the equation Eq. 6 in accordance with the actually measured projectile velocity (Vm), which results in $$\begin{aligned}&(\bar{a}_{rel}(v_m)\cdot D_1t^*(v_m)+D_3\bar{v}_G(t^*(v_m),\ P\bar{o}s_o,\ v_m),\ \bar{p}rel(v_m)+(\bar{v}_{rel}(v_m),\\ &\bar{v}_{rel}(v_m)\cdot D_1t^*(v_m)+D_3\bar{p}_G(t^*(v_m),P\bar{o}s_o,\ v_m))=0 \qquad \text{Eq. 7}\end{aligned}$$

—insertion of a hit condition Eq. 3, contained as a marginal condition in the system of the differential equations of ballistics, into Eq. 7, taking into consideration the definition of t*

$$t^*(v_o)=TG$$

$$\bar{p}rel(v_o)=\bar{p}_G(TG,\ P\bar{o}s_o,\ v_o)-\bar{p}_z(t_o+TG)=0$$

from which follows $$D_1t^*(v_o)=-\frac{<\bar{v}_{rel}(v_o),\ D_3\bar{p}_G(TG,\ P\bar{o}s_o,\ v_o)>}{<\bar{v}_{rel}(v_o),\ \bar{v}_{rel}(v_o)>} \qquad \text{Eq. 7.1}$$

for Vm=Vo from equation Eq. 7, —simplification of equation Eq. 7 by inserting the definition $$\frac{\partial\bar{p}_G}{\partial v_o}=D_3\bar{p}_G(TG,\ P\bar{o}s_o,\ v_o)$$

wherein the correction factor (K) results as $$K=D_1t^*(v_o)=-\frac{<\bar{v}_{rel}(v_o),\ \frac{\partial\bar{p}_G}{\partial\bar{v}_o}>}{<\bar{v}_{rel}(v_o),\ \bar{v}_{rel}(v_o)>} \qquad \text{Eq. 8}$$

wherein $D_1$ and $D_3$ are intermediate values, wherein inf indicates a minimum value, and wherein, the following meanings apply

| | |
|---|---|
| $\vec{p}_G, \vec{\upsilon}_G, \vec{\alpha}_G$ | position, velocity, acceleration of the projectile |
| $\vec{p}_Z, \vec{\upsilon}_Z, \vec{\alpha}_Z$ | position, velocity, acceleration of the target |
| $\vec{p}_{rel}, \vec{\upsilon}_{rel}, \vec{\alpha}_{rel}$ | relative position, velocity, acceleration projectile-target |
| $\vec{Pos}$ | position of the mouth of the barrel |
| $\vec{\upsilon}_0$ | initial lead velocity of the projectile |
| $\upsilon_0$ | amount of the component of the initial lead velocity of the projectile in the barrel direction |
| $\upsilon_m$ | amount of the component of the effective initial speed of the projectile in the barrel direction |
| TG | lead flying time of the projectile |
| t* | flying time of the projectile |
| $t_0$ | time at which the projectile passes the mouth of the barrel |

2. A process for determining a fuze time for disaggregation of a programmable projectile (18) shot from a gun barrel (13) toward a target, the process comprising:

measuring a projectile measured muzzle velocity (Vm);

determining, from target sensor data, an impact distance (RT) from the gun barrel to the target;

subtracting a predetermined disaggregation distance (Dz) from the impact distance, the predetermined disaggregation distance being a difference between an impact point (Pf) and a disaggregation point (Pz) of the projectile;

calculating as a function of the measured muzzle velocity a corrected disaggregation time Tz(Vm) according to $$Tz(Vm)=Tz+K\ (Vm-Vov)$$

where Vov is a projectile average muzzle velocity, Tz is a nominal disaggregation time corresponding to the projectile average muzzle velocity, and K is a correction factor;

wherein the correction factor K is determined at least in part by determining a predicted relative separation distance of the projectile and the target as a function of time and setting a time derivative of the function equal to zero.

3. The process in accordance with claim 2, wherein the predicted relative separation distance includes the actually measured projectile velocity Vm as an independent variable.

* * * * *